US005607520A

United States Patent [19]

Tipton

[11] Patent Number: 5,607,520

[45] Date of Patent: Mar. 4, 1997

[54] REEL-TO-REEL PASSIVATION OF STAINLESS STEEL WIRE

[75] Inventor: David G. Tipton, Serverna Park, Md.

[73] Assignee: Northrop Grumman Corporation, Los Angeles, Calif.

[21] Appl. No.: 516,858

[22] Filed: Aug. 18, 1995

[51] Int. Cl.[6] ..... C25F 1/00

[52] U.S. Cl. ..... 148/241; 205/320; 205/138

[58] Field of Search ..... 205/320, 138; 148/241

[56] References Cited

U.S. PATENT DOCUMENTS

| | | | |
|---|---|---|---|
| 3,247,086 | 4/1966 | Goldstein | 205/138 |
| 3,287,237 | 11/1966 | Wilton | 204/140 |
| 3,637,466 | 1/1972 | Girard | 205/138 |
| 4,610,798 | 9/1986 | Burkus | 252/79.2 |
| 4,612,095 | 9/1986 | Omata | 204/144.5 |
| 5,342,503 | 8/1994 | Byler | 205/138 |

OTHER PUBLICATIONS

"Federal Specification Passivation Treatments for Corrosion–Resistant Steel" QQ–P–35C Oct. 28, 1988.

*Primary Examiner*—Sam Silverberg
*Attorney, Agent, or Firm*—Philip A. Florenzo

[57] ABSTRACT

A method and apparatus for performing continuous reel-to-reel passivation of a stainless steel wire usable in an underwater electromechanical or optical cable of a mine hunting sonar or similar marine system, which supplies the stainless steel wire, under tension, immerses a first portion of the stainless steel wire in 10–20% nitric acid bath at ambient temperature; applies a current from a DC power supply to the immersed first portion of the stainless steel wire, advances the stainless steel wire, under tension, to repeat the immersing and current supplying on a second portion of the stainless steel wire, washes the first portion of the stainless steel wire in a flowing water wash, dries the first portion of the stainless steel wire with forced air, advances the stainless steel wire, under tension, to repeat the washing and drying on the second portion of the stainless steel wire, and stores the stainless steel wire under tension.

12 Claims, 2 Drawing Sheets

FIG. 1
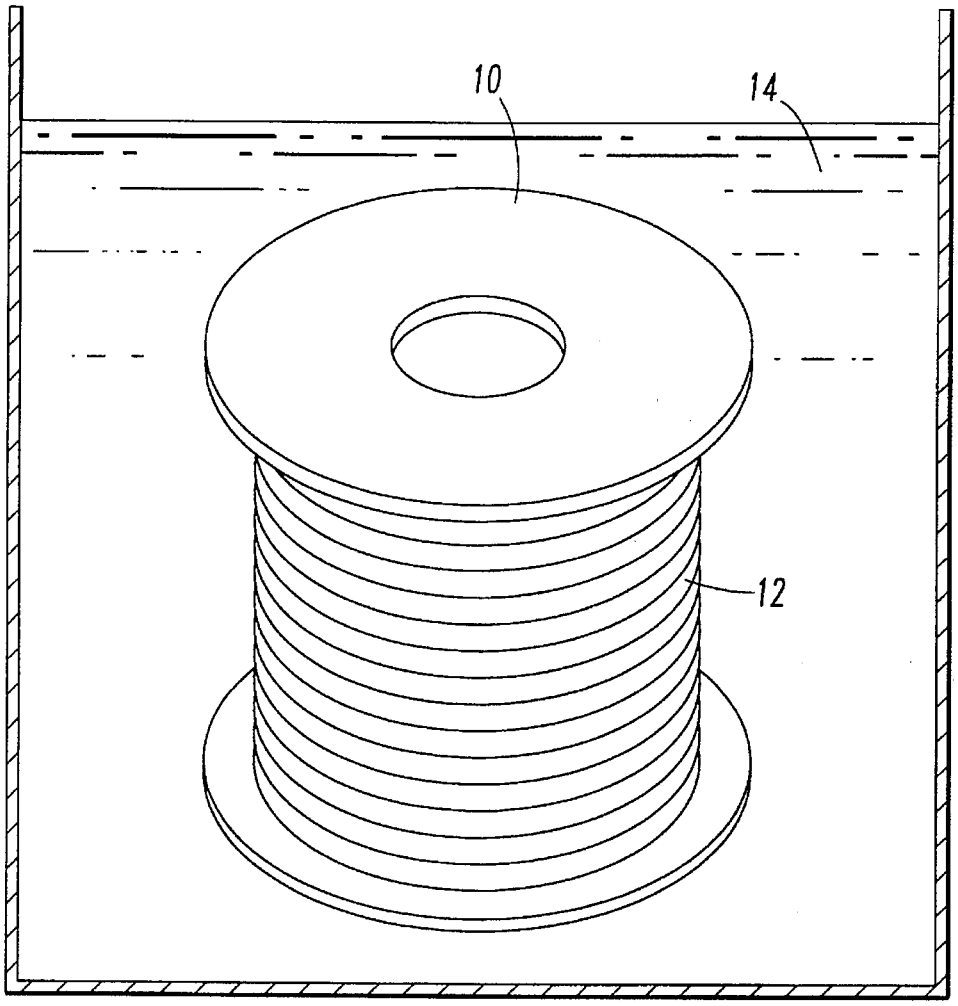
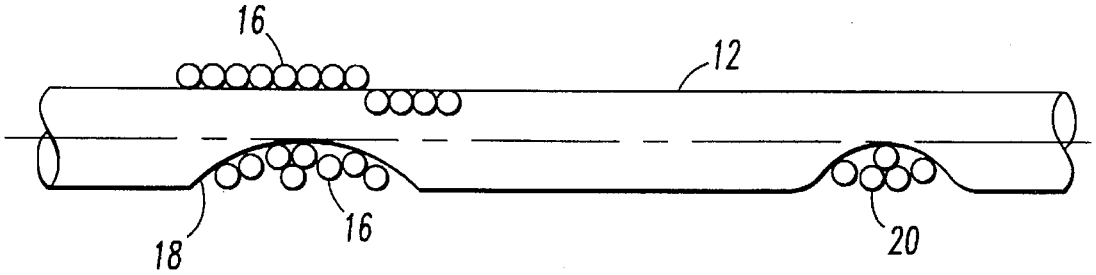
FIG. 2

FIG. 3
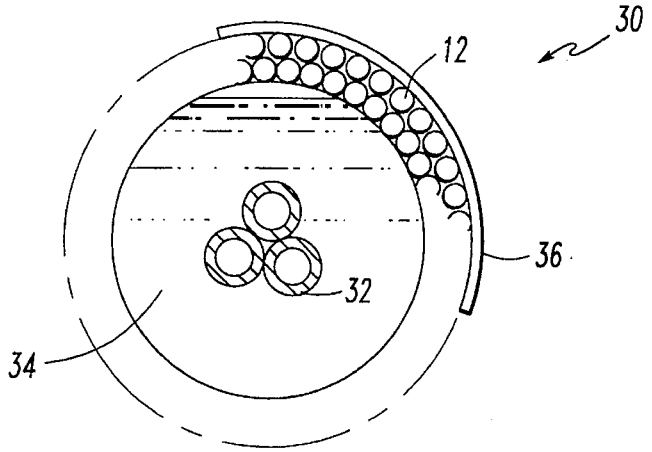
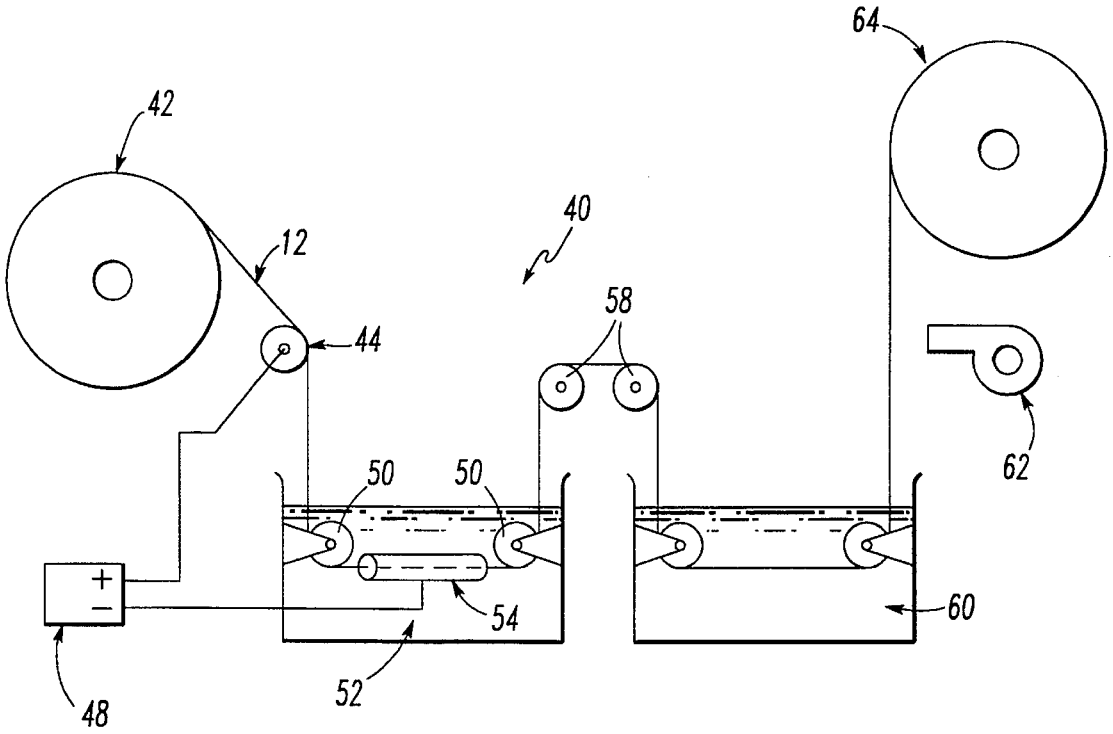
FIG. 4

REEL-TO-REEL PASSIVATION OF STAINLESS STEEL WIRE

BACKGROUND OF THE INVENTION

The invention relates generally to an apparatus and method for the passivation of stainless steel wire. In particular, the apparatus and method of the present invention electrochemically accelerate the process of chemical passivation of stainless steel wire in order to speed the process to the point that passivation can be performed on continuous long lengths of wire.

Currently, the passivation of stainless steel articles, such as a spool of stainless steel wire, is a chemical batch process which involves totally immersing the article to be treated in an acid, such as a 20% nitric acid bath for 20 minutes or more, as illustrated in FIG. 1. A spool 10 of stainless steel wire 12 is completely immersed in a nitric acid bath 14. The batch process in FIG. 1 is not particularly effective, because it takes too long and because most of the stainless steel wire 12 is shielded from the nitric acid bath 14 by the outermost wraps of the stainless steel wire around the spool 10. As a result, a majority of the stainless steel wire 12 is not exposed to the nitric acid bath 14. One other problem with the batch process illustrated in FIG. 1 is that the nitric acid itself will corrode the stainless steel wire 12 if left for long periods of time. Because of the spool arrangement, it is difficult to remove all of the nitric acid from within the wraps of the stainless steel wire.

The purpose of a passivation process is to chemically clean embedded iron and/or non-metallic inclusions from the surface of a machined metal article, in order to optimize corrosion resistance of the article. These embedded iron and non-metallic inclusions are likely sites for pitting and crevice corrosion of stainless steel in seawater. A typical stainless steel wire 12 is illustrated in FIG. 2. The stainless steel wire typically has a radius of 0.013 to 0.050 inches. During the process of manufacturing the stainless steel wire, iron particles 16 may be either embedded or smeared on the stainless steel wire 12. These iron particles can serve as initiation sites for pitting corrosion, wherein the size of the pit 18 could be as large as the radius of the stainless steel wire 12 itself. Additionally, the stainless steel wire 12 may be subject to other elements, such as chloride ions 20, which also cause crevice corrosion of the stainless steel wire 12. Both pitting and crevice corrosion may lead to mechanical failure of the stainless steel wire 12.

Stainless steel armor wires in marine electromechanical or optical cables are especially vulnerable to mechanical failure after pitting or corrosion, due to the small diameter of the wires, which is on the same order of magnitude as the corrosion pits themselves. A cross-section of an electromechanical/optical cable 30 is illustrated in FIG. 3. The optical or other data cables 32 are located at the center of the electromechanical/optical cable 30 and are covered with a water block 34. Stainless steel wire 12, acting as a strength member, surrounds the water block 34 and the stainless steel wire 12 is further surrounded by an external covering 36. One problem with the electromechanical/optical cable 30 illustrated in FIG. 3 is that crevice corrosion may form between the stainless steel wire 12 and the water block 34.

The present invention solves these problems with conventional passivation techniques by electrochemically accelerating the process of chemical passivation of stainless steel. The present invention permits rapid electrochemical removal of embedded or surface iron contaminants and removes as many possible corrosion sites to thereby enhance the corrosion resistance of stainless steel armor wires used for electromechanical cables for seawater applications. The electrochemically accelerated passivation techniques of the present invention sufficiently reduce the time required in the acid bath to allow continuous reel-to-reel process to passivate very long armor wires.

Electrochemically accelerated passivation enables passivation to be performed as a reel-to-reel process on long lengths of stainless steel wire. The process removes embedded iron and/or surface iron contamination, sites of more likely corrosion damage in sea water. Long lengths of stainless steel wires have not typically been passivated, since the conventional batch process is not conducive to multi-layer spools of wire and the geometric shielding of the inner wraps of wire. Continuous passivation of wire enhances the corrosion resistance of stainless steel armor wire used for electromechanical cables for sea water applications.

SUMMARY OF THE INVENTION

One object of the present invention is to provide a method and apparatus for electrochemically accelerating the process of chemical passivation of stainless steel.

Another object of the present invention is to provide a method and apparatus of passivating a stainless steel wire by immersing the stainless steel wire in an acid bath and applying a current from a DC power supply to the stainless steel wire immersed in the acid bath, in order to accelerate the process of chemical passivation to allow continuous reel-to-reel passivation of very long stainless steel wires.

Another object of the present invention is to provide a method and apparatus for accelerating the chemical passivation of stainless steel wire utilized in electromechanical/optical cables, used in mine-hunting sonar systems.

These objects of the present invention are fulfilled by providing a method of passivation of a stainless steel wire, comprising the steps of (a) immersing the stainless steel wire in an acid bath; (b) applying a current from a DC power supply to the stainless steel wire, immersed in said step (a); and (c) advancing the stainless steel wire to repeat said steps (a) and (b) so that the stainless steel wire is continuously passivated.

These objects of the present invention are further fulfilled by providing an apparatus for passivating a stainless steel wire, comprising an acid bath for immersing the stainless steel wire, a DC power supply for applying a current to the stainless steel wire, immersed in said acid bath, and advancing means for advancing the stainless steel wire so that the stainless steel wire is continuously passivated.

These objects of the present invention are further fulfilled by providing a method for performing continuous reel-to-reel passivation of a stainless steel wire usable in an underwater electromechanical or optical cable of a mine hunting sonar, or similar marine system, comprising the steps of: (a) supplying the stainless steel wire, under tension, (b) immersing a first portion of the stainless steel wire in 10–20% nitric acid bath at ambient temperature, (c) applying a current from a DC power supply to the first portion of the stainless steel wire, immersed in said step (b), (d) advancing the stainless steel wire, under tension, to repeat steps (b) and (c) on a second portion of the stainless steel wire, (e) washing the first portion of the stainless steel wire in a flowing water wash, (f) drying the first portion of the stainless steel wire with forced air, (g) advancing the stainless steel wire, under tension, to repeat steps (e) and (f) on the second portion of the stainless steel wire, and (h) storing the stainless steel wire under tension.

These objects of the present invention are further fulfilled by an apparatus for performing continuous reel-to-reel passivation on a stainless steel wire usable in an underwater electromechanical or optical cable of a mine hunting sonar or similar marine system, comprising a supply reel for storing and feeding the stainless steel wire, under tension, prior to passivation, an acid bath for immersing a first portion of the stainless steel wire, a DC power supply for applying a current to the first portion of the stainless steel wire, immersed in said acid bath, a first plurality of tensioners for advancing the stainless steel wire, under tension, so that a second portion of the stainless steel wire is immersed in said acid bath and the current is applied to the second portion of the stainless steel wire, a second plurality of tensioners for advancing the stainless steel wire, under tension so that the second portion of the stainless steel wire is washed in said flowing water wash, a forced air source for drying the first portion of the stainless steel wire, and a take up reel for storing the stainless steel wire after passivation.

These and other objects of the present invention will become more readily apparent from the detailed description given hereafter. However, it should be understood that the detailed description of the specific examples, while indicating preferred embodiments of the invention are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only and thus do not limit the present invention, wherein, FIG. 1 illustrates a conventional chemical batch process for passivating stainless steel articles;

FIG. 2 illustrates a conventional stainless steel wire;

FIG. 3 illustrates the cross-section of an electromechanical/optical cable; and FIG. 4 illustrates the apparatus of the present invention, in a preferred embodiment.

Further scope of applicability of the present invention will become apparent from the detailed description given hereafter. However, it should be understood that the detailed description and specific examples, while indicating preferred embodiments of the invention are given by way of illustration only, since various changes and modifications within the spirit and scope of the invention will become apparent to those skilled in the art from this detailed description.

DETAILED DESCRIPTION OF THE PREFERRED EMBODIMENT

The overall apparatus 40 for the passivation of stainless steel wire 12 is illustrated in FIG. 1. The apparatus 40 includes a supply reel 42 for continuously supplying the stainless steel wire 12. The stainless steel wire is routed over a tensioner/electrical contact 44, to which the anode 46 of a constant current DC power supply 48 is attached. The stainless steel wire 12 is routed through a first pair of tensioners 50 located in a bath of 10% to 20% nitric acid 52 at ambient temperature. Also immersed in the nitric acid bath is a tubular or screen electrode 54, to which the cathode 56 of the constant current DC power supply 48 is attached. The stainless steel wire 12 is routed through a second pair of tensioners 58 into a flowing water wash bath 60, then passed through a forced air source 62 and retrieved on a take-up reel 64.

In operation, the stainless steel wire 12 is removed from the supply reel 42 under tension, and routed over the tensioner/electrical contact 44, to which the anode 46 of the constant current DC power supply is attached. The stainless steel wire 12 is further routed over a first pair of tensioners 50 in the nitric acid bath 52. The nitric acid bath is preferably 1 to 20% nitric acid. In a more preferred embodiment, the nitric acid bath is 10–20% nitric acid. In a preferred embodiment, the nitric acid bath has a dimension of less than 1 foot, such that less than 1 foot of the stainless steel wire is in the nitric acid bath at any given time. The constant current DC power supply 48 supplies a current to 1 to 100 milliamps across anode 46 and cathode 56. The stainless steel wire is routed over a second pair of tensioners 58 into a flowing water wash and then forced air dried and wound on take-up reel 64.

The configuration illustrated in FIG. 4 sufficiently reduces the time required for any one portion of the stainless steel wire 12 to be in the acid bath such that a continuous reel-to-reel process for passivation of very long wire, on the order to 10,000 feet, is achievable. Further, the stainless steel wire 12 may be advanced from the supply reel 42 to the take-up reel 64 continuously or incrementally.

The apparatus of the present invention utilizes electrochemical acceleration of the process of chemical passivation of the stainless steel wire, in order to speed the passivation process such that passivation can be performed on continuous long length of wire. The electrochemically accelerated passivation enables passivation to be performed as a reel-to-reel process on long lengths of stainless wire. The process removes embedded iron and/or surface iron contamination, sites of more likely corrosion damage in sea water. Long lengths of stainless steel wire are not typically passivated since the conventional batch process is not conducive to multi-layer spools of wire and the geometric shielding of the inner wraps of wire. The continuous passivation of wire will enhance corrosion resistance to stainless steel armor wire used for electromechanical and optical cables for sea water application.

The application of a stimulated DC electrochemical current allows rapid chemical surface cleaning, equivalent to chemical passivation in accordance with the Federal Specification for the Passivation Treatments for Corrosion-Resistant Steel QQ-P-35C dated Oct. 28, 1988. The application of a controlled current to a short immersed segment of stainless steel wire will selectively corrode away any embedded iron or iron contamination while leaving the stainless steel wire unaffected. The DC current is applied to the immersed segment of wire by connecting the anode 46 of the constant current DC power supply 48 to tensioner/electrical contract 44 and connecting the cathode 56 of the constant current DC power supply 48 to the tubular or screen electrode 54, as illustrated in FIG. 4.

FIG. 4 and the detailed description disclosed above, describe a preferred embodiment of the present invention. However, the constant current DC power supply 58 could be replaced with a galvanostat, which can precisely hold a constant current. In addition to being part of an electromechanical/optical cable, the stainless steel wire could also be utilized in medical applications, which currently utilize batch passivation of short cut lengths, for example, as a fiber for stitching. Additionally, the stainless steel wire could be welding wire or part of wire rope, which may include an elastomer center. The electromechanical/optical cable utilizing the nonmagnetic stainless steel wire passivated as described above is extremely useful in mine-hunting sonar programs such as the U.S. Navy's AN-AQS-14 mine-hunting sonar program.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of passivation a stainless steel wire, comprising the steps of:

(a) immersing the stainless steel wire in an acid bath;

(b) applying a continuously constant DC current from a constant current DC power supply to the stainless steel wire, immersed in said step (a); and (c) advancing the stainless steel wire to repeat said steps (a) and (b) so that the stainless steel wire is continuously passivated.

2. The method of claim 1, wherein said steps (a) and (b) remove inclusion sites which cause corrosion in the stainless steel wire.

3. The method of claim 1, wherein the stainless steel wire is an armor wire in a marine electromechanical or optical cable.

4. The method of claim 1, wherein said step (a), the acid bath is a 10–20% nitric acid bath at ambient temperature.

5. The method of claim 1, wherein said step (b), the continuously constant DC current is 1–100 mA.

6. The method of claim 1, further comprising the steps of:

(d) washing the stain less steel wire in a flowing water wash; and (e) drying the stainless steel wire with forced air.

7. The method of claim 3, wherein the marine electromechanical or optical cable is used in a marine system.

8. The method of claim 7, wherein the marine system is a marine hunting sonar system.

9. The method of claim 6, wherein the stainless steel wire is wound on a supply reel prior to said steps (a) and (b) and fed under tension, through the acid bath and the flowing water wash and wound on a take up reel.

10. The method of claim 1, wherein said step (c) continuously advances the stainless steel wire.

11. The method of claim 1, wherein said step (c) incrementally advances the stainless steel wire.

12. A method for performing continuous reel-to-reel passivation of a stainless steel wire usable in an underwater electromechanical or optical cable of a mine hunting sonar system, comprising the steps of:

(a) supplying the stainless steel wire, under tension;

(b) immersing a first portion of the stainless steel wire in 10–20% nitric acid bath at ambient temperature;

(c) applying a continuously constant DC current from a constant current DC power supply to the first portion of the stainless steel wire, immersed in said step (b);

(d) advancing the stainless steel wire, under tension, to repeat steps (b) and (c) on a second portion of the stainless steel wire;

(e) washing the first portion of the stainless steel wire in a flowing water wash;

(f) drying the first portion of the stainless steel wire with forced air;

(g) advancing the stainless steel wire, under tension, to repeat steps (e) and (f) on the second portion of the stainless steel wire; and (h) storing the stainless steel wire under tension.

* * * * *